US007765649B2

(12) United States Patent
Katada et al.

(10) Patent No.: US 7,765,649 B2
(45) Date of Patent: Aug. 3, 2010

(54) CHUCK AND CHUCK-EQUIPPED BAG

(75) Inventors: Ryo Katada, Sodegaura (JP); Kenichi Tanaka, Sodegaura (JP); Takehiro Iwamoto, Sodegaura (JP)

(73) Assignee: Idemitsu Unitech Co., Ltd., Bunkyo-ku, Tokyo (JP)

( * ) Notice: Subject to any disclaimer, the term of this patent is extended or adjusted under 35 U.S.C. 154(b) by 264 days.

(21) Appl. No.: 11/664,507

(22) PCT Filed: Oct. 3, 2005

(86) PCT No.: PCT/JP2005/018269

§ 371 (c)(1),
(2), (4) Date: Apr. 3, 2007

(87) PCT Pub. No.: WO2006/038578

PCT Pub. Date: Apr. 13, 2006

(65) Prior Publication Data

US 2007/0266532 A1 Nov. 22, 2007

(30) Foreign Application Priority Data

Oct. 4, 2004 (JP) ..... 2004-291869

(51) Int. Cl.
*B65D 33/24* (2006.01)

(52) U.S. Cl. ..... 24/30.5 R; 24/389; 24/585.12; 24/DIG. 50

(58) Field of Classification Search ..... 24/30.5 R, 24/384, 389, 399, 400, 585.12, 585.11, DIG. 50, 24/DIG. 39; 383/61.2, 61.3, 63, 64; 493/213, 493/214; 53/133.4, 139.2, 412
See application file for complete search history.

(56) References Cited

U.S. PATENT DOCUMENTS

| | | | | |
|---|---|---|---|---|
| 3,440,696 | A * | 4/1969 | Staller | 24/586.1 |
| 5,293,672 | A * | 3/1994 | Tominaga et al. | 24/585.1 |
| 7,514,143 | B2 * | 4/2009 | Matsumura et al. | 428/354 |
| 2004/0091179 | A1 * | 5/2004 | Anderson | 383/63 |

FOREIGN PATENT DOCUMENTS

| | | | |
|---|---|---|---|
| JP | 06239356 | A * | 8/1994 |
| JP | 2000344251 | A | 12/2000 |
| JP | 2003319806 | A | 11/2003 |

* cited by examiner

*Primary Examiner*—James R Brittain
(74) *Attorney, Agent, or Firm*—Millen, White, Zelano & Branigan, P.C.

(57) ABSTRACT

The inner bottom (222*b*) of a female-like projection (22*b*) is provided with an elastic viscous material (4) continuous along the longitudinal direction so as to bulge into a space defined between hooks (221*b*, 221*b*) of the female-like projection (22*b*). When a female-like projection (21*a*) is fitted in the female-like projection (21*b*), the elastic viscous material (4) is pressed against the head (221*a*) of the male-like projection (22*a*) so as to be abutted against the head (221*a*) of the male-like projection (22*a*) while undergoing elastic deformation, and is in intimate contact with the surface of the front end side of the head (221*a*) by the adhesive force and elastic force, whereby the airtightness of the zipper-equipped bag can be secured.

11 Claims, 6 Drawing Sheets

CHUCK AND CHUCK-EQUIPPED BAG

TECHNICAL FIELD

The present invention relates to a fitting type zipper so constituted that it can be resealed and reopened, the zipper being improved in airtightness, and a zipper-equipped bag provided with the zipper.

BACKGROUND ART

Zipper-equipped bags provided with a fitting type zipper (fitting tool) in openable and closable at a port in and from which the content is taken have been used in many fields such as beddings, clothes, foods, chemicals and miscellaneous goods (for example, Patent Documents 1 and 2).

These zipper-equipped bags are usually produced in the following manner: a zipper formed into a tape is prepared in advance and a base film as a bag raw material is sealed with the zipper to make a bag.

Patent Document 1: Japanese Patent Application Laid-Open (JP-A) No. 6-239356

Patent Document 2: Japanese Patent Application Publication (JP-B) No. 4-22789

DISCLOSURE OF THE INVENTION

Problem to be Solved by the Invention

In the meantime, a zipper-equipped bag of this type has the following problem. Because it is necessary to enable resealing and reopening by fitting and unfitting utilizing the elastic deformation of a male-like projection and a female-like projection formed in the zipper and to secure, a manufacturing tolerance, it is difficult to fit the above both projections to each other in a perfectly close contact condition and the airtightness of the bag cannot be secured. In order to solve such a problem, various proposals have been offered. However, there has been no satisfactory proposal for remedies yet.

For example, Patent Document 1 discloses technologies improving the airtightness by forming elastic packings united with the male and female members on the fitting wall surfaces of these members facing each other.

However, in the case of Patent Document 1, the airtightness is secured only by bring each elastic packing into close contact with the male and female-like projections. When external force such as bending or twisting force act on the zipper, a clearance is formed between the elastic packing and the projections, the airtightness is decreased significantly. This poses the problem that no airtightness can be ensured though depending on a working condition.

Also, Patent Document 2 discloses an airtight fitting tool made to have airtightness by forming an adhesive layer on the lower part of the bottom side of the internal wall surface of a female-like projection (female claw) side.

However, Patent Document 2 is designed to provide airtightness by sealing a female-like projection (female claw) and a male-like projection (male claw) with an adhesive. Therefore, the adhesion must be made higher to secure airtightness. If the adhesion is made higher, this poses the problem that strong power is required to unfit the fitting tool, causing disorders such as stickiness of the adhesive, resulting in inconvenience for actual use as a package bag.

Moreover, generally, when a zipper-equipped bag is made, a base film is sealed with a zipper and then, the zipper positioned at the side seal part is heated and pressed to crush (so-called zipper crushing) by a heat block, followed by side sealing to avoid a sealing inferior caused by the bulkiness of the zipper.

The zipper-equipped bag made in this manner has the problem that the fitting part of the male and female-like projections at the crushed part of the zipper is deformed and an air leak passage is formed through this part, so that satisfactory airtightness is not obtained even if the zipper itself has airtightness.

As mentioned above, a zipper-equipped bag of this type has the problem that not only it is difficult to provide airtightness to the zipper itself but also airtightness is impaired when making the bag. Therefore, this bag is regarded as unsuitable to applications needing airtightness such as applications for storing liquid materials or applications requiring gas barrier characteristics.

The present invention was proposed to solve such problems involved in the aforementioned prior art and it is an object of the present invention to provide a zipper which can secure the airtightness of a zipper-equipped bag to thereby make it possible to apply it widely to applications to which the zipper has been conventionally regarded as unsuitable, thereby making it possible to improve its convenience and also to provide a zipper and a zipper-equipped bag.

Means for Solving the Problem

A zipper according to the present invention includes a male member formed with a male-like projection and a female member formed with a female-like projection, wherein the male-like projection and the female-like projection are fitted to each other along the longitudinal direction in such a manner as to enable resealing and reopening, the zipper further including an elastic viscous material which is bulged into the part where the front end side of the male-like projection is facing the inner bottom side of the female-like projection, the elastic viscous material being integrated with the male-like projection and/or the female-like projection.

This ensures that the contact between the elastic viscous material and the male-like projection or the female-like projection is well maintained due to the adhesive force and elastic force of the elastic viscous material, whereby the airtightness of the zipper can be secured.

In the zipper according to the present invention, if the elastic viscous material is disposed on at least the part corresponding to the zipper crushed part present when the zipper is applied to a bag base material to make a bag, the generation of an air leak passage in the crushed part of the zipper can be prevented. Also, if the elastic viscous material is continuously formed along the longitudinal direction of the male-like projection and/or the female-like projection, the airtightness of the zipper itself can be secured.

Also, the material used for the elastic viscous material is preferably one including a synthetic rubber type polymer and an adhesion-imparting agent and the hardness of the elastic viscous material is preferably 2 to 20 N/1 $cm^3$ and the adhesive strength of the elastic viscous material is preferably 2 to 8 N/10 mm.

Also, in order to improve the airtightness of the zipper, the shoulder part of the male-like projection is preferably brought into close contact with the part of the opening part side of the female-like projection by forced power acting on the female-like projection owing to the elastic force of the elastic viscous material when the male-like projection is fitted in the female-like projection. Also, the proportion of the elastic viscous material in a space formed between the male-like projection and the female-like projection when the male-like projection is fitted in the female-like projection is preferably 30 to 80% in terms of sectional area ratio on the surface perpendicular to the longitudinal direction of the zipper.

On the other hand, a zipper-equipped bag according to the present invention has a structure including a zipper as those mentioned above. This enables the provision of an airtight bag equipped with a zipper.

EFFECT OF THE INVENTION

According to the present invention, the contact between the elastic viscous material and the male-like projection or the female-like projection is well maintained due to the adhesive force and elastic force of the elastic viscous material, whereby the airtightness of the zipper can be secured. This ensures that it is possible to apply the zipper widely to applications needing airtightness such as applications for storing liquid materials and applications requiring gas barrier characteristics to which the zipper has been conventionally regarded as unsuitable, thereby making it possible to improve its convenience.

DESCRIPTION OF THE REFERENCE NUMERALS

| | |
|---|---|
| 1 | Bag |
| 10a, 10b | Base film |
| 2 | Zipper |
| 2a | Male member |
| 22a | Male projection |
| 221a | Head part |
| 223a | Shoulder part |
| 2b | Female member |
| 22b | Female-like projection |
| 221b | Hook part |
| 222b | Inner bottom |
| 223b | Front end part |
| 224b | Opening part |
| 4 | Elastic viscous material |
| 5 | Crushed part |
| S | Space |

BEST MODE FOR CARRYING OUT THE INVENTION

Figure 1:
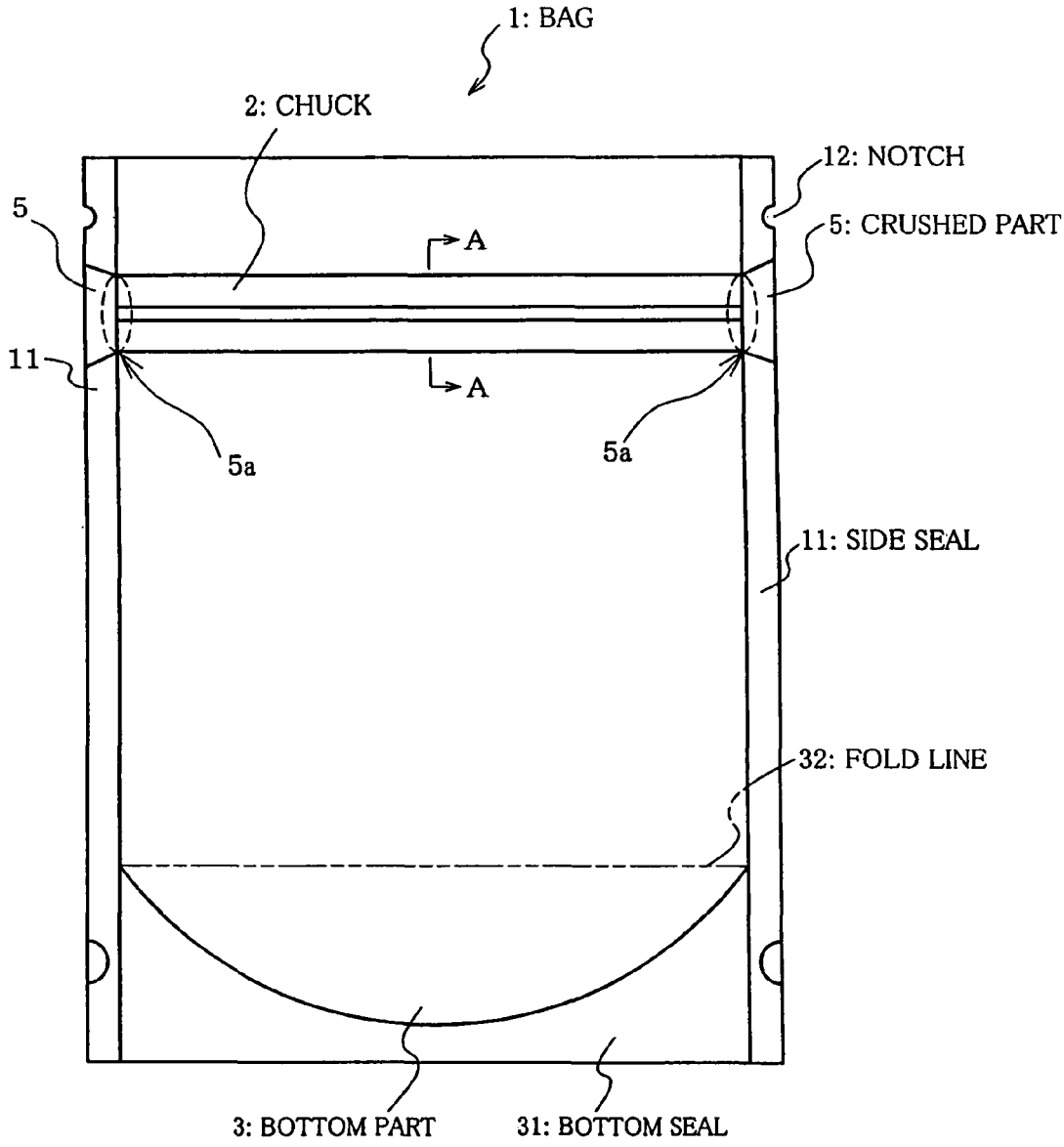
FIG. 1 is a plan view showing the outline of an embodiment of a zipper-equipped bag according to the present invention.
Figure 2:
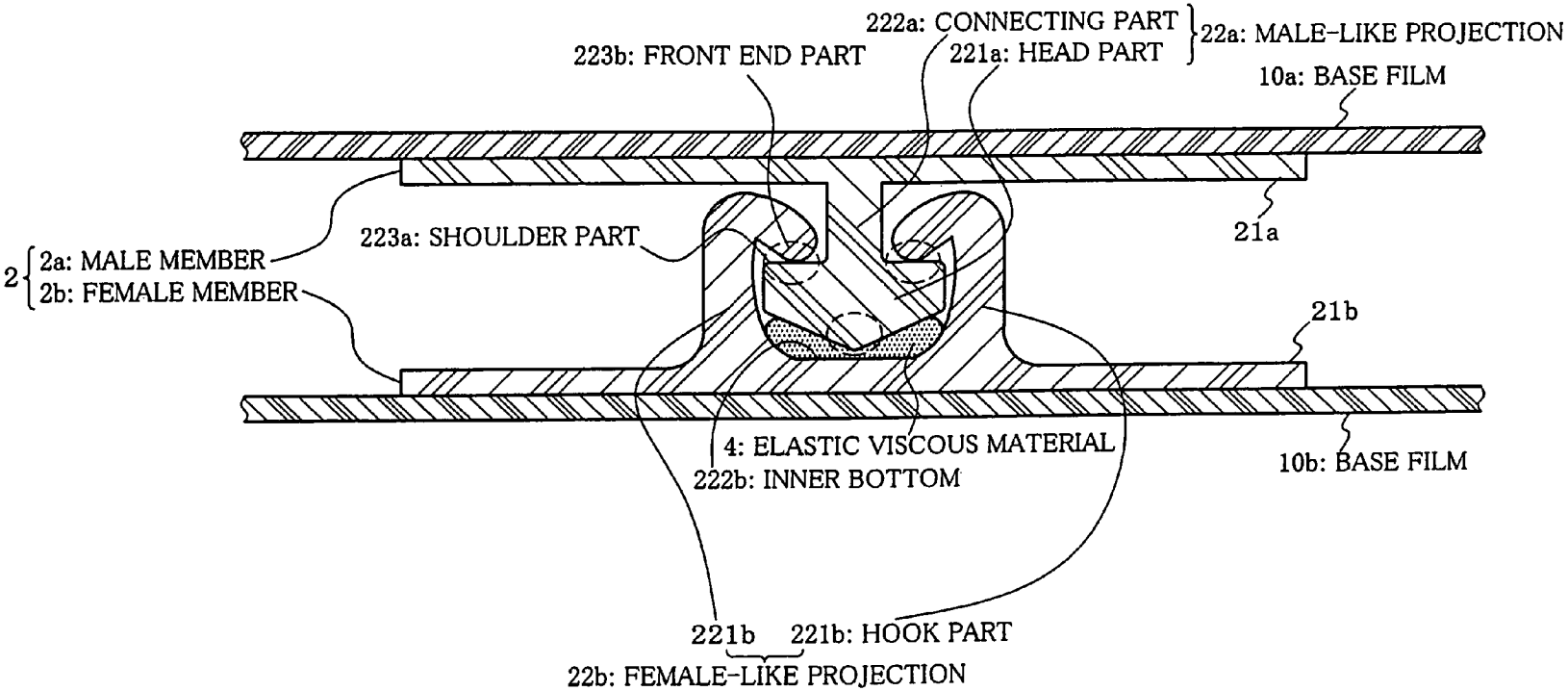
FIG. 2 is a sectional view along the line A-A in FIG. 1.

Preferred embodiments according to the present invention will be explained with reference to the drawings. FIG. 1 is a front view showing the outline of an embodiment of a zipper-equipped bag according to the present invention. FIG. 2 is a sectional view along the line A-A in FIG. 1.

A bag 1 shown in FIG. 1 is produced by making a bag using base films 10*a* and 10*b* used as a bag base material heat-sealed with a zipper 2 and is a so-called standing bag which is produced by providing a side seal 11 along the side edge of the bottom part 3 provided with a bottom seal 31 in the condition of the film folded along a fold line 32.

When providing the side seal 11 to the side edge of the bag 1, the part of the zipper 2 protruding into the side seal side 11 and including the part provided with the side seal 11 is heated and pressed to crush into a crushed part 5 and then, the side seal 11 is provided. Outline of the above part of zipper 2 is shown using the dotted line in the figure.

Also, although, in the illustrated example, the upper edge of the bag 1 is an unsealed part in the figure, it is provided with a top seal after the content is filled. The top seal is provided on the side closer to the upper edge than the line connecting paired right and left notches 12.

This ensures that after the upper edge part (provided with the top seal) of the bag 1 is cut away to open the bag 1 by utilizing the notch 12, the mouth part of the bag 1 can be closed or opened by resealing or reopening of the zipper 2.

The zipper 2 in this embodiment is constituted of paired male member 2*a* and female member 2*b* as shown in FIG. 2.

The male member 2*a* is provided with a base part 21*a* formed continuously like a tape. A male-like projection 22*a* constituted of a head part 221*a* and a connecting part 222*a* connecting the head part 221*a* with the base part 21*a* is provided on one surface of the base part 21*a* and these parts are integrated. Then, the other surface of the base part 21*a* is heat-sealed with the base film 10*a*.

Similarly, the female member 2*b* is provided with a base part 21*b* formed continuously like a tape. A female-like projection 22*b* constituted of a pair of hook parts 221*b* and 221*b* is provided on one surface of the base part 21*b* and these parts are integrated. Then, the other surface of the base part 21*b* is heat-sealed with the base film 10*b*.

As shown in FIG. 2, the head part 221*a* of the male-like projection 22*a* is fitted in a space formed between the hook parts 221*b* and 221*b* of the female-like projection 22*b*, whereby the male-like projection 22*a* and the female-like projection 22*b* are fitted to each other. The mouth part of the bag 1 is thereby sealed. When the fitting of the male-like projection 22*a* with the female-like projection 22*b* is released, the mouth part of the bag 1 is opened.

The specific shapes of the male-like projection 22*a* and female-like projection 22*b* are not limited to those shown in the figure as long as these projections have fitting shapes which are paired and fitted to each other.

The aforementioned male member 2*a* and female member 2*b* may be formed, for example, by extrusion molding of a thermoplastic resin. As the thermoplastic resin, for example, a polyolefin type resin such as polypropylene and polyethylene or an ethylene/methacrylic acid copolymer may be used.

The zipper 2 may have a multilayer structure using plural resins in consideration of the fitting characteristics of the zipper 2, the sealing strength and sealing characteristics of the zipper 2 with the base films 10*a* and 10*b*.

Also, the same thermoplastic resin may be used for the base films 10*a* and 10*b* themselves or a sealing layer disposed in contact with the zipper 2 in the case where the base films 10*a* and 10*b* are respectively a multilayer. Biaxially oriented nylon, biaxially oriented polyethylene terephthalate or biaxially oriented polypropylene may be laminated together with the heat seal layer as a surface layer in consideration of heat sealing characteristics with the zipper 2 and of a function as a bag, and an aluminum foil or an ethylene/vinyl alcohol copolymer film may be laminated as an intermediate layer in consideration of barrier characteristics.

Figure 3:
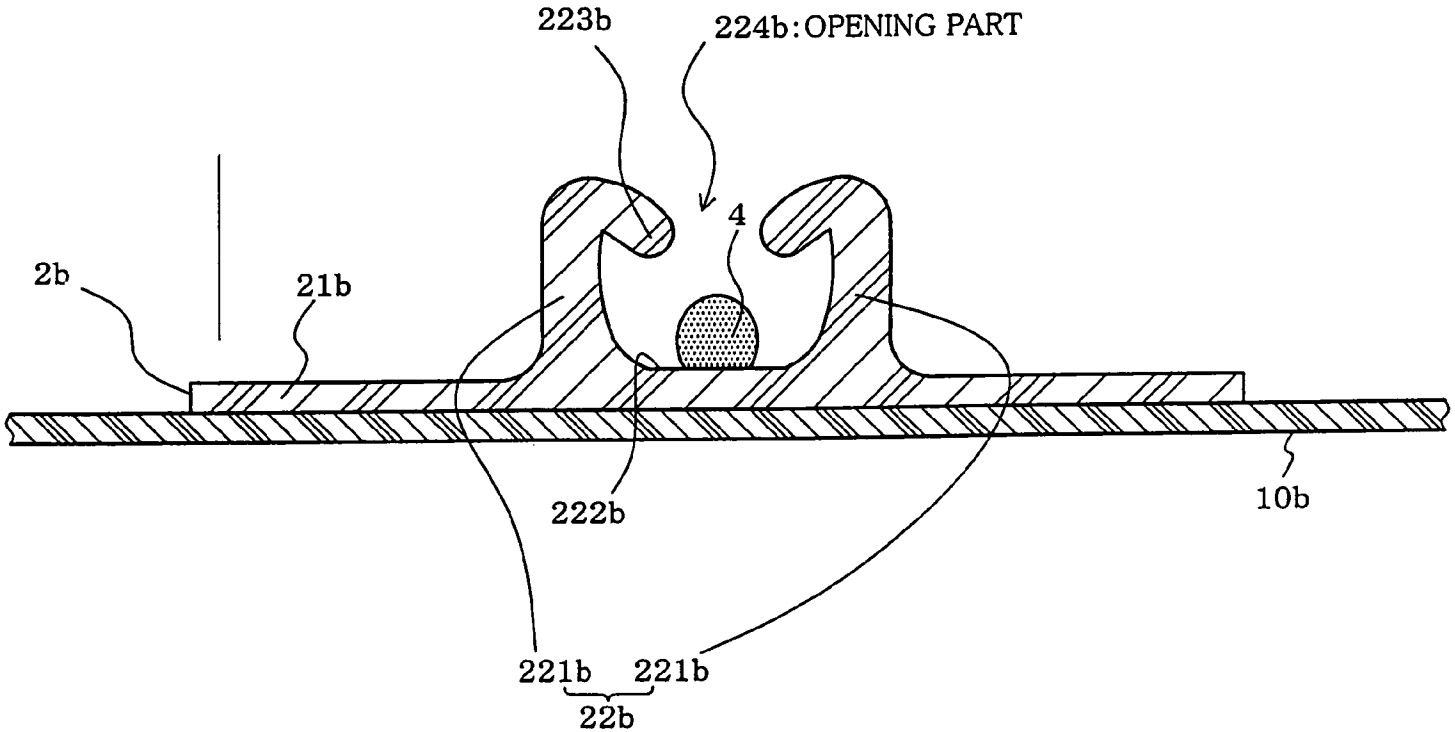
FIG. 3 is a schematic sectional view showing a female member in an embodiment of a zipper according to the present invention.

In this embodiment, as shown in FIG. 3, an elastic viscous material 4 is provided continuously along the longitudinal direction of the inner bottom 222*b* of the female-like projection 22*b* so as to bulge into a space formed between the hook parts 221*b* and 221*b* of the female-like projection 22*b*.

The elastic viscous material 4 may be integrated with the female member 2*b* simultaneously when the female member 2*b* is molded by extrusion-supplying a material forming the elastic viscous material 4 to the inner bottom 222*b* so as to carry out co-extrusion when the female member 2*b* is extrusion-molded. However, the elastic viscous material 4 may be formed by post-processing on the female member 2*b* which has been formed in advance.

In this embodiment, the elastic viscous material 4 is pressed by the head part 221*a* of the male-like projection 22*a* and brought into contact with the head part 221*a* of male-like projection 22*a* with undergoing elastic deformation when the male-like projection 22*a* is fitted in the female-like projection 22*b* and is also brought into close contact with the surface on the front end side of the head part 221*a* by its adhesive force and elastic force. Also, the male-like projection 22*a* is pressed back by the elastic force of the elastic viscous material 4 with the result that the shoulder part 223*a* of the male-like projection 22*a* is brought into close contact with the front end part 223*b* of the hook part 221*b* of the female-like projection 22*b*.

Specifically, as shown by the dotted line in FIG. 2, the head part 221*a* of the male-like projection 22*a* is brought into close contact with the elastic viscous material 4, and also, the shoulder part 223*a* of the male-like projection 22*a* is brought into close contact with the front end part 223*b* of the hook part 221*b* of the female-like projection 22*b* at each of the right and left positions in the figure, so that the male member 2*a* and female member 2*b* of the zipper 2 are in contact with each other at a total of three points in its section.

In the example illustrate here, the shoulder part 223*a* of the male-like projection 22*a* is brought into close contact with the front end part 223*b* of the hook part 221*b* of the female-like projection 22*b*. However, it is only required that optional parts positioned on the opening part 224*b* side of the female-like projection 22*b* are brought into close contact with the shoulder part 223*a* of the male-like projection 22*a* and there is no particular limitation to the specific embodiment of the contact condition.

Specifically, the reason is that the above structure is intended to make the zipper 2 airtight without fail by the close contact at total of three points including the close contact at two points and the close contact between the male-like projection 22*a* and the elastic viscous material 4.

Also, the elastic viscous material 4 is not limited to that of the embodiment in which it is formed on the female-like projection 22*b* side, but may be formed on the optional positions of the male-like projection 22*a* or both the male-like projection 22*a* and the female-like projection 22*b* insofar as it produces the same action effect. It is however preferable to form the elastic viscous material 4 on the inner bottom 222*b* of the female-like projection 22*b* to prevent fingers from touching the elastic viscous material 4 in consideration of handling in the condition that the fitting is released.

Between the male-like projection 22*a* and female-like projection 22*b* which are fitted in this state, a total of three contact parts including the contact part formed by the head part 221*a* of the male-like projection 22*a* and the elastic viscous material 4 and the two close contact parts formed between the shoulder parts 223*a* of the male-like projection 22*a* and each front end part 223*b* of the hook parts 221*b* of the female-like projection 22*b* resultantly exist.

Therefore, even in the working situation where the contact of, for example, one or two contact parts fails, the contact at other contact parts is maintained. Also, the elastic viscous material has moderate adhesive strength and therefore, the contact between the surface of the front end side of the head part 221*a* of the male-like projection 22*a* and elastic viscous material 4 is maintained also by the adhesive strength of the elastic viscous material 4.

According to this embodiment as mentioned above, even in working situations where external force such as bending force or twisting force acts on the zipper 2 as well as a situation where the zipper is used in a normal condition, the close contact between the male-like projection 22*a* and the female-like projection 22*b* or the elastic viscous material 4 is maintained, whereby sufficient airtightness can be secured.

Here, the head part 221*a* of the male-like projection 22*a* and the elastic viscous material 4 are brought into close contact with each other by the adhesive strength of the elastic viscous material 4 and therefore, particularly, the contact at the contact part formed between the head part 221*a* of the male-like projection 22*a* and the elastic viscous material 4 is not impaired with ease.

Figure 5:
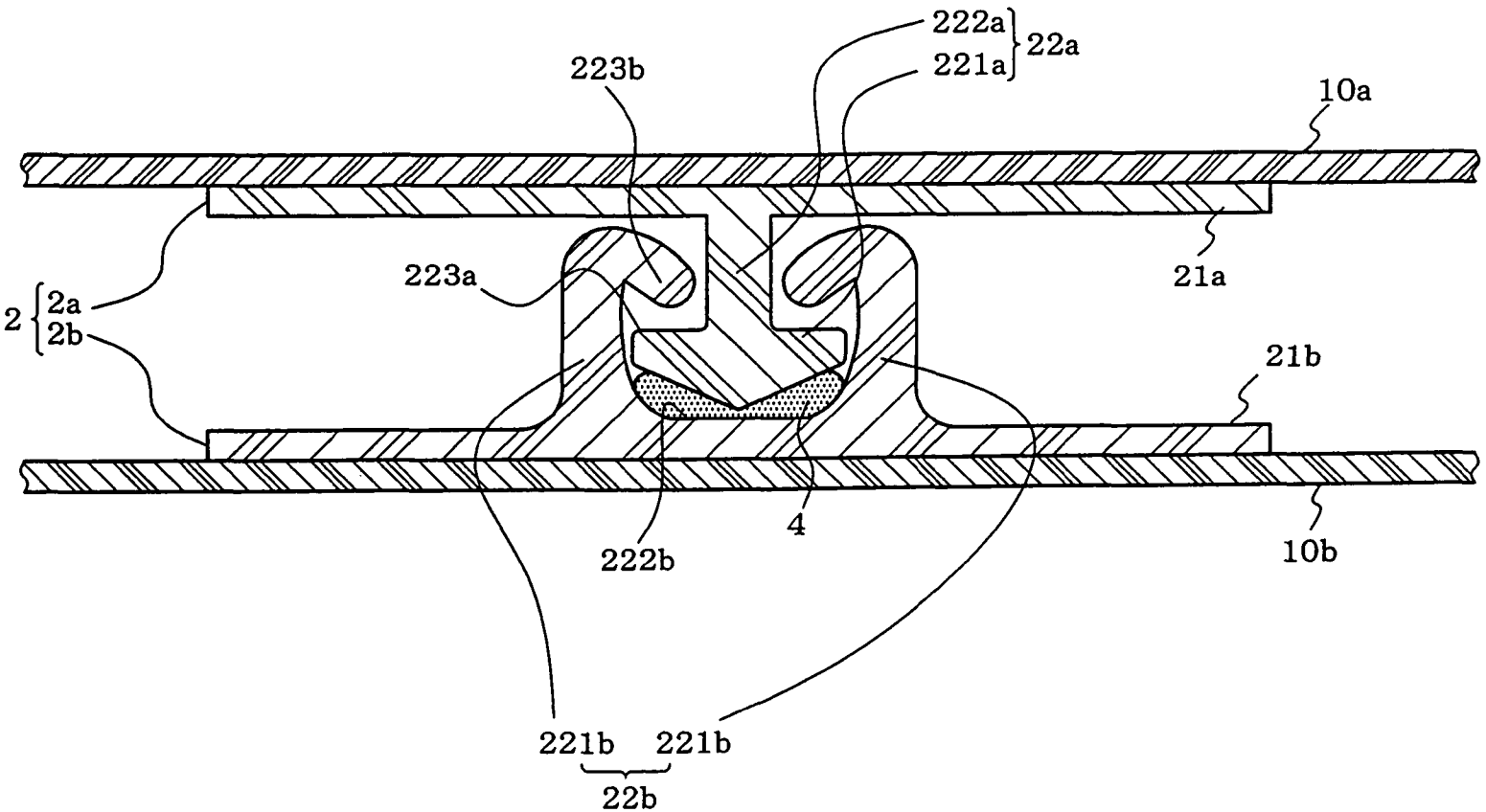
FIG. 5 is a schematic sectional view showing an example of a modification of a zipper of an embodiment according to the present invention.

For this, as shown in, for example, FIG. 5, it is possible, according to the need, to form the head part 221*a* of the male-like projection 22*a* in a relatively smaller size and air tightness can be secured only by the contact between the male-like projection 22*a* and the elastic viscous material 4.

FIG. 5 is a schematic sectional view showing an example of a modification of this embodiment and shows a part corresponding to the section A-A in FIG. 1.

Also, as mentioned above, a zipper-equipped bag of this type has the problem that the fitting part of the male and female-like projections at the crushed part of the zipper is deformed and an air leak passage is formed through this part, so that satisfactory airtightness is not obtained even if the zipper itself has airtightness. Such a leak passage is usually generated at the boundary 5*a* between the zipper 2 and the crushed part 5.

Figure 6:
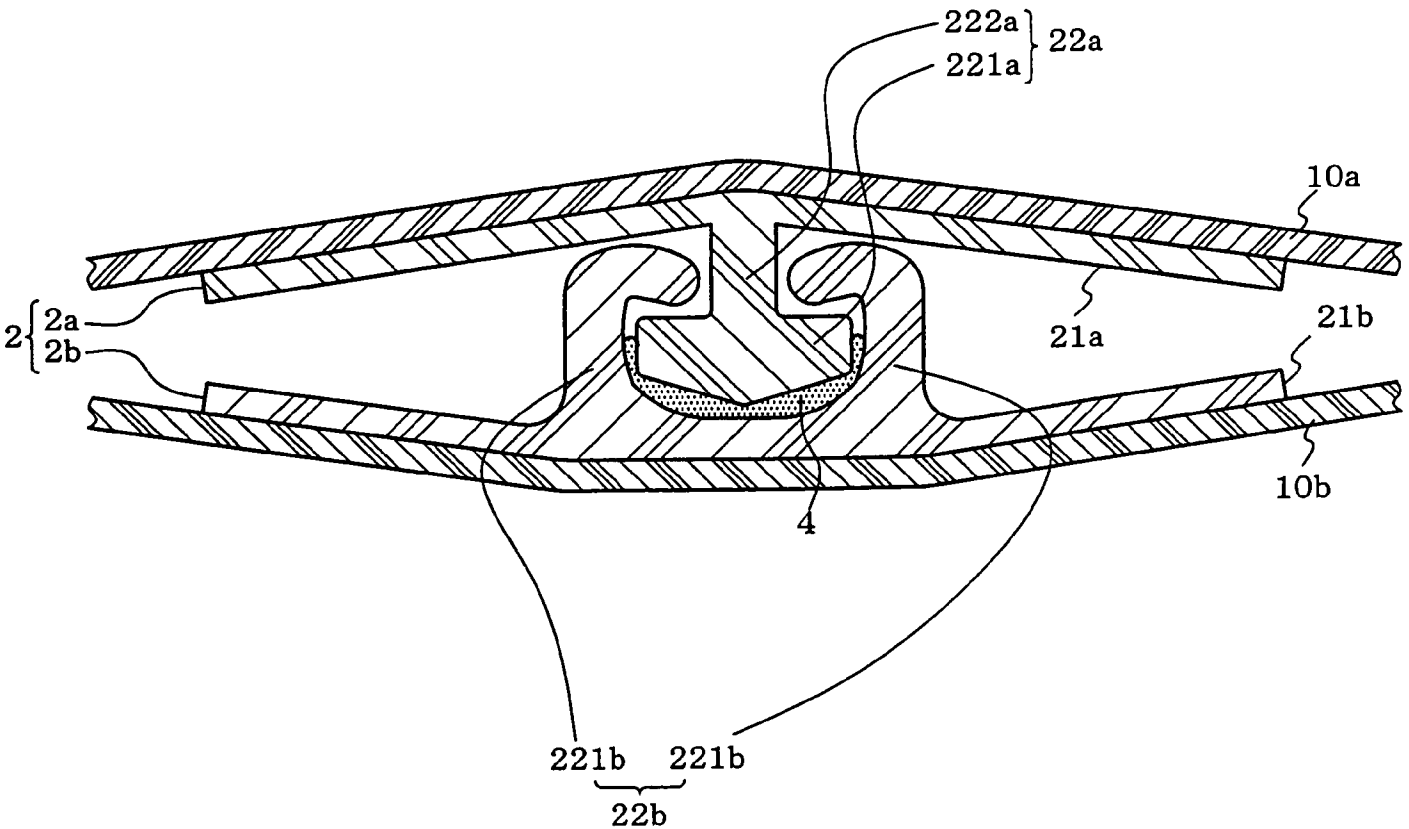
FIG. 6 is a sectional view schematically showing the section of a zipper at the boundary between the zipper and a crushed part.

In this embodiment, on the other hand, even if the fitting part of the male-like projection 22*a* and female-like projection 22*b* at the boundary 5*a* between the zipper 2 and the crushed part 5 of the zipper is deformed, the elastic viscous material 4 is spread over the inside wall surface of the female-like projection 22*b* so as to fill the space formed between the male projection 22*a* and the female projection 22*b* as shown by its outline in FIG. 6 and therefore, the generation of the leak passage can be prevented, which also improves airtightness.

FIG. 6 is a sectional view schematically showing the section of the zipper 2 at the boundary 5*a* between the zipper 2 and the crushed part 5.

The hardness of the elastic viscous material 4 in this embodiment is preferably 2 to 20 N/1 $cm^3$ and particularly preferably 3 to 10 N/1 $cm^3$.

When the hardness is less than the above range, the force for pressing the male-like projection 22*a* back is low in the aforementioned fitting condition, resulting in that the contact between the shoulder part 223*a* of the male-like projection 22*a* and the front end part 223*b* of the hook part 221*b* of the female-like projection 22*b* is unsatisfactory.

When the hardness exceeds the above range, the elastic viscous material 4 is elastically deformed with difficulty, which is a hindrance to the fitting of the male-like projection 22*a* to the female-like projection 22*b*, which makes it difficult to fit the both to each other.

Here, the hardness of the elastic viscous material 4 may be measured according to JIS K7215, and means a value measured in the following manner. Specifically, the elastic viscous material 4 is cut into a cube having a volume of 10 $mm^3$ to make a test piece. And then, using a measuring device (for example, a digital force gauge manufactured by IMADA CO., LTD may be utilized) fitted with an indenter having a tip angle (apex angle) of 40°, the indenter is pressed against the elastic viscous material 4 with increasing force to measure the value of force when the elastic viscous material 4 is crushed by 50% (5 mm) by the indenter.

Also, the adhesive strength of the elastic viscous material is preferably 2 to 8 N/10 mm and particularly preferably 3 to 6 N/10 mm.

When the adhesive strength is less than the above range, the contact with the male-like projection 22*a* is insufficient and the condition of the contact with the male-like projection 22*a* due to the adhesive force of the elastic viscous material 4 cannot be maintained when external force such as bending force or twisting force acts on the zipper 2.

When the adhesive strength exceeds the above range, not only it becomes difficult to unfit the engagement of the male-like projection 22*a* with the female-like projection 22*b* but also disorders such as sticking are caused, resulting in inconvenience for actual use.

Here, the adhesive force means the largest load when a test piece prepared by applying an adhesive material in a thickness of 20 μm to a PET film 50 μm in thickness is brought into close contact with SUS (Steel Use Stainless) and then, the test piece is peeled from SUS at an angle of 180° at a measuring temperature of 20° C. by a tensile tester. This maximum load is defined as 180° peeling adhesive strength.

Moreover, when the elastic viscous material 4 is formed, the size of the elastic viscous material 4 preferably one satisfying the condition that the proportion of the elastic viscous material 4 in a space S (see FIG. 4) formed between the male-like projection 22*a* and the female-like projection 22*b* when the male-like projection 22*a* is fitted in the female-like projection 22*b* is preferably 30 to 80% and particularly preferably 40 to 70% in terms of sectional area ratio on the surface perpendicular to the longitudinal direction of the zipper 2.

When the size is less than the above range, the contact area between the elastically deformed elastic viscous material 4 and the male-like projection 22*a* is small and it is therefore difficult to maintain the contact condition of the both, with the result that sufficient airtightness is not obtained. Also, in order to maintain the close contact condition, the adhesive force of the elastic viscous material 4 must be increased as much as the contact area is decreased. However, if the adhesive strength of the elastic viscous material 4 is excessively strong, disorders like those as mentioned above are caused.

When the size exceeds the above range, this is a hindrance to the fitting of the male-like projection 22*a* and the female-like projection 22*b*, and it is therefore difficult to fit the male-like projection 22*a* in the female-like projection 22*b*.

Figure 4:
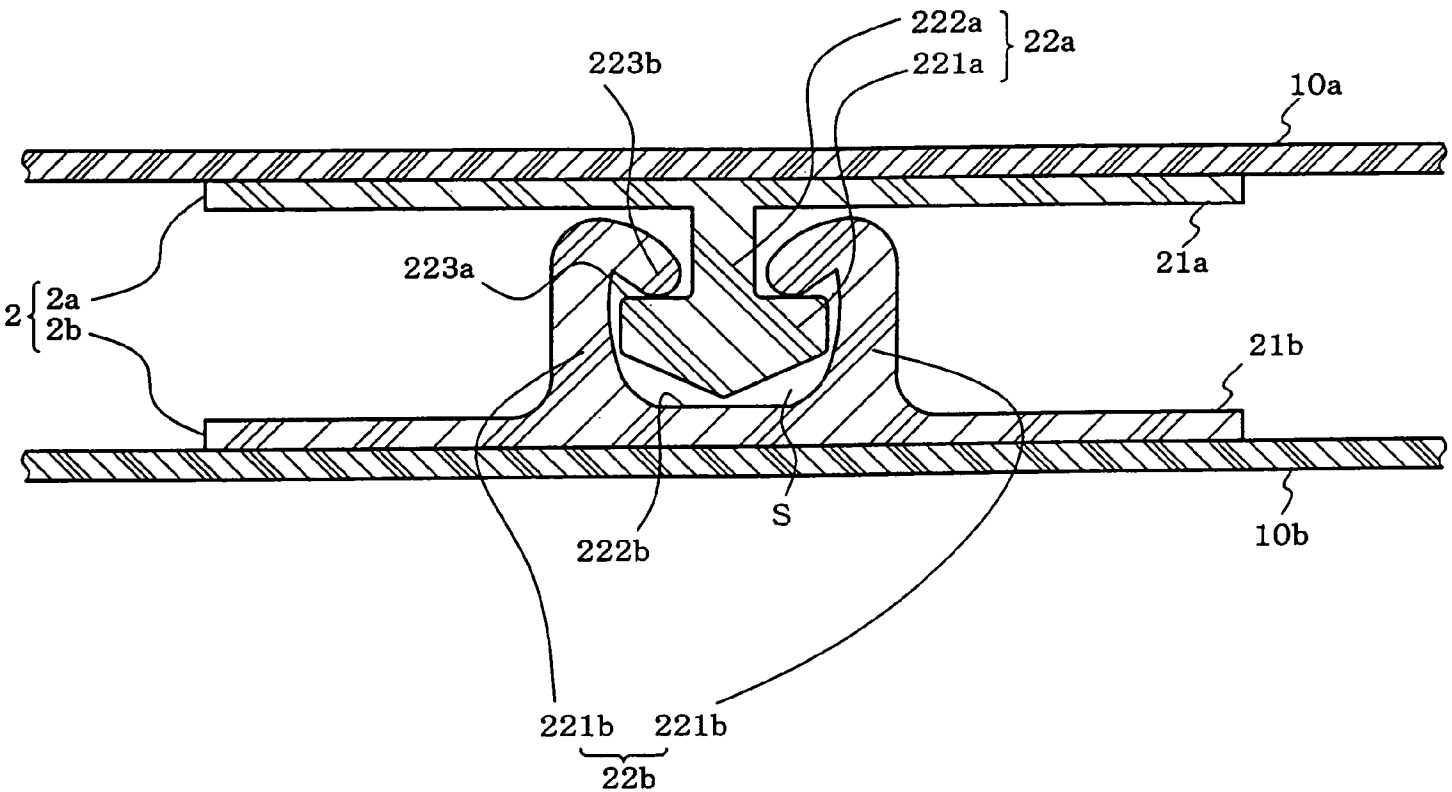
FIG. 4 is a schematic sectional view of a zipper showing the state of the zipper provided with no elastic viscous material.

Here, the aforementioned space S means a space formed between the male-like projection 22*a* and the female-like projection 22*b* when under the condition of normal temperature and normal pressure (25° C., 1 atom), the male-like projection 22*a* is fitted in the female-like projection 22*b* and, as shown in FIG. 4, the shoulder part 223*a* of the male-like projection 22*a* is brought into contact with the front end part 223*b* of the hook part 221*b* of the female-like projection 22*b* in such a manner as to prevent the generation of the deformation of the male-like projection 22*a* and female-like projection 22*b* as much as possible.

FIG. 4 is a schematic sectional view of the zipper 2 in the condition of the zipper 2 provided with no elastic viscous material 4 and shows the part corresponding to the section along the line A-A of FIG. 1.

In this embodiment, the hardness, adhesive strength and size of the elastic viscous material 4 are properly set within the above ranges in consideration of the elasticity of the material forming the zipper 2, the shape and dimension of the zipper 2 and the level of the airtightness to be required.

As the material of the elastic viscous material 4, an elastic one using a synthetic rubber type polymer as its major component is used and also the elastic one to which an adhesive imparting agent is further added to appropriately control the hardness and adhesive strength may be used.

As the synthetic rubber type polymer, synthetic rubber type polymers such as a styrene type block polymer, butyl rubber, partially crosslinked butyl type and polyisobutylene type are exemplified. Among these polymers, particularly, a styrene type block polymer is preferable in view of material balance.

Specific examples of the styrene type block polymer include SBS (styrene/butadiene/styrene block polymer), SIS (styrene/isoprene/styrene block polymer), SEBS (styrene/ethylene butylene/styrene block polymer), SEPS (styrene/ethylene propylene/styrene block polymer) and SIBS (styrene/isobutylene/styrene block polymer). Particularly, a styrene type block polymer containing a saturated hydrocarbon is preferable as the rubber component in view of heat resistance and weatherability and SEBS (styrene/ethylene butylene/styrene block polymer), SEPS (styrene/ethylene propylene/styrene block polymer) and SIBS (styrene/isobutylene/styrene block polymer) are more preferable from the viewpoint of availability.

Also, these synthetic rubber type polymers may be used in the following condition. Specifically, according to the need, a thermoplastic resin such as a polyolefin resin, polystyrene resin, vinyl chloride resin, acryl resin or fluororesin and a plasticizer are added to the above synthetic rubber type polymer, and further an organic polymer having a saturated hydrocarbon, polyether, polyester or acryl as its principal chain skeleton and a crosslinkable functional group at the terminal of its molecule (for example, an organic polymer containing at least one silicon-containing group which has a hydroxyl group or a hydrolyzable group connected to a silicon atom and can form a siloxane bond to thereby crosslink) is mixed or kneaded and the above organic polymer is crosslinked.

Examples of the above plasticizer include thermoplastic resins such as a polyolefin resin, polystyrene resin, vinyl chloride resin, acrylic resin and fluororesin, polyvinyl type oligomers such as a polybutene, hydrogenated polybutene, hydrogenated α-olefin oligomer and atactic polypropylene, aromatic oligomers such as biphenyl and triphenyl, hydrogenated polyene type oligomers such as a hydrogenated liquid polybutadiene, paraffin type oligomers such as paraffin oil and chlorinated paraffin, cycloparaffin type oligomers such as naphthenic oil, phthalates such as dibutyl phthalate, diheptyl phthalate, di(2-ethylhexyl)phthalate, butylbenzyl phthalate, di-n-octyl phthalate, diisononyl phthalate, diisodecyl phthalate and diundecylphthalate, non-aromatic dibasic acid esters such as di(2-ethylhexyl) adipate, di-n-octyl adipate, diisononyl adipate, diisodecyl adipate, di(2-ethylhexyl)sebacate and 2-ethylhexyl tetrahydrophthalate, aromatic esters such as tri-2-ethylhexyl trimellitate and triisodecyl trimellitate, fatty acid esters such as butyl oleate, methyl acetylricinolate and pentaerythritol ester, esters of polyalkylene glycols such as diethylene glycol benzoate and triethylene glycol dibenzoate, phosphates such as tricresyl phosphate and tributyl phosphate and epoxy plasticizers such as epoxidated soybean oil and epoxidated linseed oil.

Examples of the adhesion imparting agent include aromatic hydrocarbon type resins, aliphatic hydrocarbon type resins, hydrogenated alicyclic hydrocarbon type resins, alicyclic hydrocarbon type resins, Coumarone resins, terpene type resins and rosin derivatives.

Then, the present invention will be explained in more detail by way of specific examples.

Example 1

A low-density polyethylene was melt-extruded to extrusion-mold a female member and at the same time, an elastic viscous material containing a SIS-type synthetic rubber as its major component (Morescomelt LT-170, manufactured by Matsumura Oil Research corp.) was extruded to the inner bottom of the female member to integrate it with the female member as shown in FIG. 3. Also, a male member was formed by extrusion-molding with the same material that was used for the female member.

The shapes of the male member and female member were designed to be almost the same as those shown in FIG. 2. The proportion of the elastic viscous material in a space formed between the male-like projection and the female-like projection was 60% in terms of sectional area ratio on the surface perpendicular to the longitudinal direction of the zipper.

Example 2

A male member and a female member were produced in the same manner as in Example 1 except that the shapes of these members were made almost the same as those shown in FIG. 5. The proportion of the elastic viscous material in a space formed between the male-like projection and the female-like projection was 20% in terms of sectional area ratio on the surface perpendicular to the longitudinal direction of the zipper.

Comparative Example 1

A male member and a female member were produced in the same manner as in Example 1 except that a soft rubber containing a silicon rubber as its major component was used in place of the elastic viscous material containing a SIS type synthetic rubber as its major component.

Here, the adhesive strength of Morescomelt LT-170 used in Examples 1 and 2 was 2.7 N/10 mm in terms of 180° peeling adhesive strength. Also, the hardness of Morescomelt LT-170 was 3.2 N/1 $cm^3$. On the other hand, the soft rubber used in Comparative Example 1 had no adhesive strength and a hardness of 30 N/1 $cm^3$.

(Evaluation)

Each zipper produced in Examples 1 and 2 and Comparative Example 1 was applied to a base film, on which a biaxially oriented nylon film (15 μm) and straight-chain low-density polyethylene (50 μm) were dry-laminated, by heat sealing. After the zipper was crushed, a bottom material was applied to the side opposite to the zipper side by heat sealing and the side part perpendicular to the zipper was heat-sealed to make a standing bag of 150 mm×150 mm, thereby manufacturing a zipper-equipped bag.

One of the obtained zipper-equipped bags in these examples was filled with 100 ml of water and the other was filled with 100 ml of air. The bag filled with 100 ml of water was turned upside down and the bag filled with air was soaked in water to measure leakage. The results of the evaluation are as follows.

TABLE 1

| | Elastic adhesive material (elastic material) | Major component | Liquid leakage | Air leakage |
|---|---|---|---|---|
| Example 1 | Morescomelt LT-170 | SIS type synthetic rubber | ○ | ○ |
| Example 2 | Morescomelt LT-170 | SIS type synthetic rubber | ○ | Δ |
| Comparative Example 1 | Soft rubber | Silicon rubber | x | x |

(Evaluation standard)
○: No leakage was confirmed.
Δ: Slight leakage was confirmed.
x: Leakage occurred and particularly leakage from the crushed part was significant.

Although the invention has been described in its preferred embodiment, it is needless to say that the present invention is not limited only to the above embodiments and various modifications are possible within the scope of the invention.

For example, the elastic viscous material 4 is provided continuously along the longitudinal direction on the inner bottom 22*b* of the female-like projection 22*b* in the aforementioned embodiment. However, if the elastic viscous material 4 is provided on the part corresponding to the zipper crushed part 5 when at least the zipper 2 is applied to the base films 10*a* and 10*b* by heat sealing to make a bag, an air leak passage produced usually at the boundary 5*a* between the zipper 2 and the crushed part 5 can be prevented. In this case, other proper measures may be applied to the zipper 2 itself to impart airtightness.

Also, the standing bag is exemplified to offer the explanations in the foregoing embodiment. However, the zipper-equipped bag may have an optional shape such as a flat bag.

INDUSTRIAL APPLICABILITY

As explained above, the present invention may be widely utilized for a zipper-equipped bag which is provided with a fitting type zipper at the mouth part from which the content is taken out or in such that it is freely opened or closed.

The invention claimed is:

1. A zipper comprising a male member formed with a male projection and a female member formed with a female groove, wherein said male projection and female grooves are fitted to each other along the longitudinal direction in such a manner as to enable resealing and reopening, the zipper further comprising an elastic viscous material having an adhesive strength of 2 to 8 N/10 mm, which elastic viscous material is bulged into the part where a front end side of said male projection is facing an inner bottom side of said female groove, said elastic viscous material containing a synthetic rubber and an adhesion-imparting agent, the elastic viscous material being integrated with both or either of said male projection and said female groove.

2. The zipper according to claim 1, wherein said elastic viscous material is disposed on at least a crushable part corresponding to a zipper crushed part present when the zipper is applied to a bag base material to make a bag.

3. The zipper according to claim 2, wherein said elastic viscous material is provided continuously along the longitudinal direction of both or either of said male projection and female groove.

4. The zipper according to claim 1, wherein said elastic viscous material is provided continuously along a crushable longitudinal direction of both or either of said male projection and female groove.

5. The zipper according to claim 1, wherein a shoulder part of said male projection is brought into close contact with a part of an opening part side of said female groove by forced power acting on said female groove owing to the elastic force of said elastic viscous material when said male projection is fitted in said female groove.

6. The zipper according to claim 5, wherein the proportion of said elastic viscous material in a space formed between said male projection and said female groove when said male projection is fitted in said female groove is 30 to 80% in terms of sectional area ratio on the surface perpendicular to the longitudinal direction of the zipper.

7. The zipper according to claim 1, wherein the proportion of said elastic viscous material in a space formed between said male projection and said female groove when said male projection is fitted in said female groove is 30 to 80% in terms of sectional area ratio on the surface perpendicular to the longitudinal direction of the zipper.

8. A zipper according to claim 1 wherein said elastic viscous material contains a styrene/isoprene/styrene block polymer as a major component.

9. The zipper according to claim 1 in combination with a bag.

10. A zipper-equipped bag provided with a zipper comprising a male member formed with a male projection and a female member formed with a female groove, wherein said male projection and female groove are fitted to each other along the longitudinal direction in such a manner as to enable resealing and reopening, the zipper further comprising an elastic viscous material having an adhesive strength of 2 to 8N/10 mm, which elastic viscous material is bulged into the part where the front end side of said male projection is facing the inner bottom side of said female groove, said elastic viscous material containing a synthetic rubber and an adhesion-imparting agent, the elastic viscous material being integrated with both or either of said male projection and said female groove.

11. A zipper-equipped bag according to claim 10 wherein said elastic viscous material contains a styrene/isoprene/styrene block polymer as a major component.

* * * * *